United States Patent [19]

Pugh, III

[11] 4,333,700

[45] Jun. 8, 1982

[54] INSULATION-PENETRATING SLOTTED BEAM CONTACT ELEMENT

[75] Inventor: William E. Pugh, III, Andover, Mass.

[73] Assignee: Bell Telephone Laboratories, Incorporated, Murray Hill, N.J.

[21] Appl. No.: 152,721

[22] Filed: May 23, 1980

[51] Int. Cl.[3] ..... H01R 4/02

[52] U.S. Cl. ..... 339/97 R

[58] Field of Search ..... 339/97 R, 97 P, 98, 339/99 R

[56] References Cited

U.S. PATENT DOCUMENTS

| | | | |
|---|---|---|---|
| 3,772,635 | 11/1973 | Frye et al. | 339/99 R |
| 3,798,587 | 3/1974 | Ellis et al. | 339/99 P |
| 4,099,822 | 7/1978 | Carlisle et al. | 339/98 |
| 4,116,522 | 9/1978 | Reynolds | 339/97 R |
| 4,136,628 | 1/1979 | McGonigal et al. | 29/630 R |
| 4,136,920 | 1/1979 | Scholtholt et al. | 339/98 |

FOREIGN PATENT DOCUMENTS

| | | | |
|---|---|---|---|
| 2142850 | 3/1973 | Fed. Rep. of Germany | 339/97 R |

*Primary Examiner*—James L. Jones, Jr.
*Attorney, Agent, or Firm*—J. W. Fisher

[57] ABSTRACT

A slotted beam contact element (10, 110), which can penetrate insulation (224) surrounding a conductor (202), includes cutting edges (44, 136) and snagging surfaces (42, 134) disposed along a substantially V-shaped entrance (18, 118) to a wire-gripping slot (20, 120) at a location remote from a mouth (32, 128) to the wire-gripping slot. The cutting edges and snagging surfaces are capable of removing outer portions (229) of the insulation so that insulation-penetrating means (56, 127) in the region of the wire-gripping slot can penetrate the remaining insulation to establish electrical contact between the conductor and the contact element.

19 Claims, 6 Drawing Figures

INSULATION-PENETRATING SLOTTED BEAM CONTACT ELEMENT

TECHNICAL FIELD

This invention relates to connectors which electrically terminate insulated conductors, and more particularly to insulation-penetrating slotted beam contact elements.

BACKGROUND OF THE INVENTION

U.S. Pat. No. 4,099,822, issued to A. W. Carlisle et al. and assigned to the assignee of this application, discloses a modular connector for joining large groups of wires. This connector has rearrangeable components capable of being separated and joined with other components to effect connections between different groups of wires. As a result, this connector is ideal for new equipment installations, equipment retrofits, in-service equipment cutovers, and equipment moves for reuse in telephone central offices.

The capability of this connector, however, depends in large part on the slotted or orbifurcated beam contact element used to make the occasional reconnects necessary during the life of any central office equipment. The contact element must permit a number of reliable electrical connections, say ten, with any given wire at the same point.

The contact element disclosed in Carlisle et al. is made of a high strength conductive material, such as a spinodal Cu-Ni-Sn alloy, in accordance with the method disclosed in U.S. Pat. No. 4,136,628. It is configured to be sufficiently gentle to allow multiple insertions of a given wire at the same point. Also, the contact element is contoured with constant strength furcations to have sufficient elasticity to accommodate a wide range of conductor sizes, i.e. 22–26 gauge, without permanent deformation or misalignment of the furcations.

However, there is room for improvement of the contact element disclosed in Carlisle et al., which is configured for penetrating the typical soft plastic insulation, such as polyvinyl chloride (PVC), on a wire. In telephone central offices, wire insulations other than the relatively soft and thin PVC insulation are found. Because of the more abrasive environments encountered by some wires, conductors are sometimes surrounded by a thicker insulation jacket comprising an inner layer of polyvinyl chloride (PVC) and a tough outer layer of cotton lacquered serving (CL). Cotton lacquered serving is historically difficult to displace with a slotted beam contact element.

With the contact element disclosed in Carlisle et al, a conductor with the typical soft plastic insulation needs to be inserted only once to effect a reliable first electrical connection. However, a conductor insulated with the PVC-CL insulation or other insulations having tough outer layers or just an extremely thick jacket of tough insulation, must be inserted twice to ensure complete penetration of the insulation to establish reliable electrical contact with the conductor for the first connection. Unfortunately, this requires that a craftsperson remember to make the double insertion for some first connections.

Hence, there is need for a slotted beam contact element which can penetrate the tough and thicker wire insulation, such as PVC-CL jacket, in one insertion and is effective with the typical PVC insulated conductor as well. At the same time, the slotted beam contact element needs to be sufficiently gentle on the wire to permit subsequent insertions.

Desirably, the contact element can still accommodate conductors having a wide range of gauges.

Also desirably, the contact element is inexpensive to manufacture.

SUMMARY OF THE INVENTION

Pursuant to the invention, a slotted beam contact element has been developed which can effectively penetrate the tough and thicker insulation surrounding a conductor in one insertion, and still be sufficiently gentle to permit a number of reliable electrical connections with the conductor at the same contact point.

The inventive slotted beam contact element includes first insulation-penetrating or insulation-removing means disposed along a substantially V-shaped entrance to a wire-gripping slot at a location remote from the mouth of the wire-gripping slot. The first insulation-penetrating means aggressively cuts away outer portions of the insulation surrounding the conductor.

Then a second insulation-penetrating means in the region of the wire-gripping slot penetrates the remaining insulation, which is usually made of soft insulation material, to establish electrical contact with the conductor. The second insulation-penetrating means is also used to penetrate the typical soft plastic-insulated conductors. As a result, one contact element can accommodate both the soft plastic-insulated conductors and the tough and thicker, say PVC-CL, insulated conductors, requiring only one insertion in either case for the first connection.

Pursuant to another aspect of the invention, the first insulation-penetrating means on the slotted beam contact includes surfaces with which the removed or severed outer-insulation portions can engage to supply inward forces on both furcations of a slotted beam in a contact element. This helps to limit the amount the contact element opens around the thicker insulation. This also helps to reduce the impact of the larger outside diameter of the thicker insulated conductors on the second insulation-penetrating means in the region of the slot.

The invention and its objects, features, and advantages will be readily discerned from a reading of the description to follow of illustrative embodiments.

DETAILED DESCRIPTION

Figure 1:
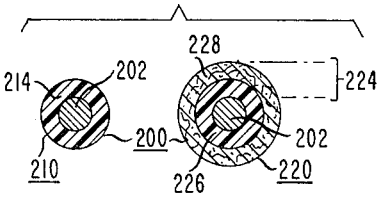
FIG. 1 is a cross-sectional view of some of the more commonly encountered insulated conductors in telephone central offices.

For reference purposes, FIG. 1 shows first and second wires or insulated conductors 200, also denoted by 210 and 220 respectively, which are used in telephone central offices. The wire 210 comprises a conductor 202 surrounded by insulation 214 made of a soft plastic jacket such as polyvinyl chloride (PVC). For some applications, the PVC jacket is sometimes irradiated to form a tough plastic jacket. Often, a much thicker irradiated PVC jacket is used. In wire 220, the conductor 202 is surrounded by a jacket of insulation 224 comprising an inner layer 226 of soft insulation, such as PVC, and then a tough outer layer 228, such as cotton lacquered serving. To allow comparison of the insulations as to thickness, the conductors 202 in both wires 210, 220 are illustrated with the same diameter.

Figure 2:
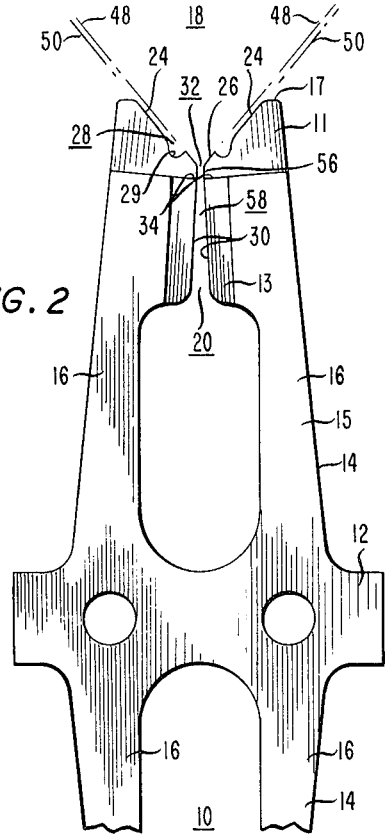
FIG. 2 shows in front elevation one illustrative embodiment of a slotted beam contact element made in accordance with this invention.

Depicted in FIG. 2 is a first illustrative embodiment 10 of the inventive insulation-penetrating slotted beam contact element. This contact element 10, which is a planar structure made from a strip of conductive material such as the high strength spinodal Cu-Ni-Sn alloy mentioned earlier, comprises a central base portion 12 and two beams 14 extending bilaterally therefrom. Each beam 14 is bifurcated or slotted to form furcations 16. The furcations 16, which are similar to the furcations on the contact element disclosed in Carlisle et al, are elastic and capable of high pressure contact.

The front surface 15 of the contact element 10 has been coined to form coined regions 11 and 13 on each furcation 16, hence resulting in a reduced thickness of these regions with respect to the rest of the slotted beam contact element 10. Also, the regions 11 are coined to have a thickness somewhat less than the regions 13 (seen in FIG. 3).

Near their free ends 17, the furcations 16 comprise inclined sidewalls 24 and 26, which substantially define a substantially V-shaped wire-guiding entrance 18, and planar sidewalls 30 which define a tapered wire-gripping slot 20. At their ends adjacent the entrance 18, the planar sidewalls 30 define a mouth 32 to the wire-gripping slot 20. The surface on the sidewalls 24, 26, and 30 are substantially normal to the plane of the contact element 10.

The surface on each of the sidewalls 26 curves and undergoes a gentle radius, approximately 5 mils in this embodiment, in the region of the mouth 32 to the wire-gripping slot 20 to form a smooth and continuous surface with the surface on its associated sidewall 30. Also, the sidewall 24 on each furcation 16 is set back with respect to its associated sidewall 26, though both sidewalls 24, 26 have substantially the same angularity. Accordingly, the sidewall 26 on each furcation 16 is substantially contained in a first plane as denoted by broken line 48, while the associated sidewall 24 is contained in a second plane, as denoted by broken line 50.

Furthermore, on each furcation 16, an indentation 28 appearing as a substantially concave surface 29 between the sidewalls 24 and 26 also modifies the otherwise general V-shape of the entrance 18. This concave surface 29 is also substantially normal to the plane of the contact element 10. Adjacent the sidewall 24, the concave surface 29 is curved and undergoes a gentle radius to form a smooth and continuous surface with sidewall 24.

Figure 3:
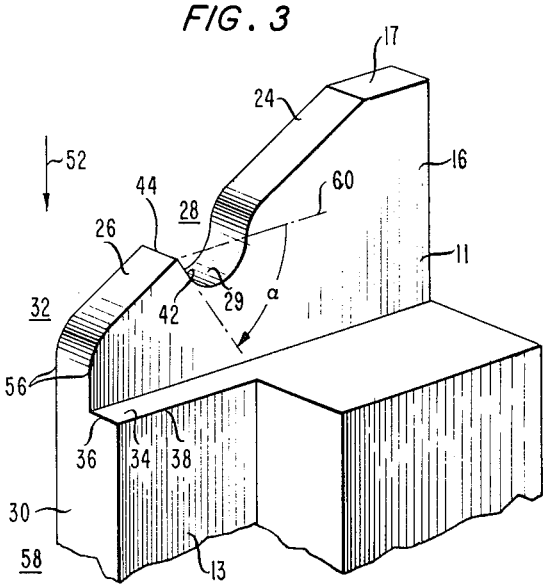
FIG. 3 is a partial front perspective view of one of the furcations on the FIG. 2 contact element.

As can be seen in greater detail in FIG. 3 on one of the furcations 16, each sidewall 26 intersects with its associated concave surface 29 to define a sharp cutting edge 44 substantially normal to the plane of the contact element 10. Adjacent the cutting edge 44, the concave surface 29 defines a surface region 42, which faces toward the free end 17 and away from the wire-gripping slot 20 (FIG. 2). The surface region 42 forms a positive rake angle $\alpha$ with respect to the downward direction, as denoted by arrow 52, in which a wire 220 is inserted. The angle $\alpha$ of the surface region 42 is measured with respect to a plane denoted by broken lines 60, which is perpendicular to the downward and vertical direction 52 of wire insertion and the plane of the contact element 10.

Referring to both FIGS. 2 and 3, the sidewalls 30 and 26 in the region of the mouth 32 form insulation-slicing edges 56 which are capable of penetrating the soft plastic or PVC insulation 214, 226 and establishing electrical contact with a conductor 202. Also, the sidewall 30 on each furcation 16 undergoes an abrupt transition between the coined regions 11 and 13 along an axis normal to the plane of the contact element 10 beneath the mouth 32 to define a ledge 34 having cutting edges 36 and 38. Along the coined regions 13, the sidewalls 30 on both furcations 16 define a conductor-holding region 58 (FIG. 2).

Figure 4:
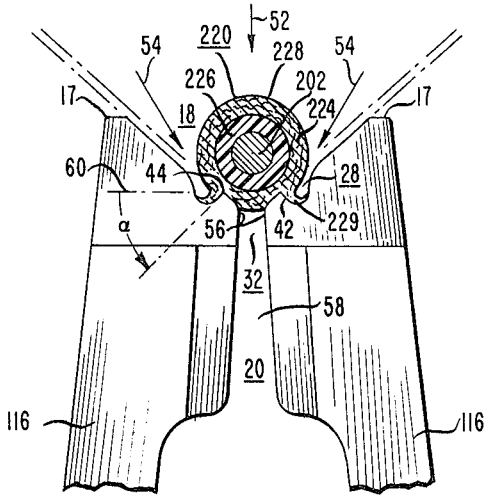
FIG. 4 depicts a PVC-CL insulated conductor being inserted into the FIG. 2 contact element.

FIG. 4 depicts the contact element 10 receiving a wire 220. As the wire 220 moves in the downward direction 52 toward the mouth 32, the cutting edges 44 aggressively cut into the insulation 224 to remove outer portions 229. At the same time, the surface regions 42 on the surfaces 29 snag the removed or severed outer-insulation portions 229.

Because of the angular orientation of the surface regions 42 with respect to the direction 52, the severed outer-insulation portions 229 supply on the surface regions 42 forces 54 having force components directed toward the wire-gripping slot 20 to resist and reduce splitting of the furcations 16 during wire insertion. The forces 54 also help the cutting edges 44 to penetrate the tough outer insulation 228. Furthermore, the force components can help increase the effectiveness of the slicing edges 56 in penetrating the remaining or inner insulation to establish electrical contact with the conductor 202 contained therein.

Advantageously, the outer-insulation removing feature along the entrance 18 is also effective in removing outer-insulation portions of the thicker irradiated PVC insulated conductors. This then eases penetration of the remaining, though tough, insulation portions in the region of the mouth 32 and the wire-gripping slot 20.

Earlier, it was mentioned that the sidewalls 24 of the entrance 18 were somewhat recessed relative to the sidewalls 26 as seen in FIG. 2. The purpose of the setback is to enhance the effectiveness of the cuting edges 44 and surface regions 42 by increasing their exposure to an insulated conductor 220 being inserted.

In the illustrative embodiment, after the cutting edges 44 have removed the outer-insulation portions 229, the slicing edges 56 come into play to penetrate the remaining insulation to establish electrical contact with the conductor 202. The cutting edges 44 and the surface regions 42 along the entrance 18 (FIG. 2) are advantageously spaced to remove sufficient outer insulation portions 229 so that the remaining insulation, which is usually the soft inner insulation, can be effectively penetrated by the slicing edges 56. It is apparent that the spacing of the cutting edges 44 can be designed to optimize the removal of the tough outer insulation layer 228 depending on the diameters of the conductor 202, the inner insulation layer 226, and the outer insulation layer 228.

Being part of the same coined region 11 on each furcation 16, each entrance sidewall 24, 26, the concave surface 29, and the sidewall 30 in the region of the mouth 32 are collinearly aligned along an axis normal to the plane of the contact element 10. Hence, the cutting edges 44 and surface regions 42 are aligned with the slicing edges 56 to miximize their cooperation in penetrating the insulation 224.

The penetration of the remaining or inner insulation on the wire 220 or the PVC insulation on the wire 210 by the slicing edges 56 is advantageously gentle because the transition from each entrance sidewall 26 to its associated sidewall 30 is gradual, thereby minimizing abrasive contacting of the conductor 202. Yet, slicing by edges 56 is effective because the region in the mouth 20 is coined to be quite thin in this embodiment so that the bearing forces on the wire 200 are quite concentrated.

Also, the resulting penetration remains gentle because the slicing edges 56 are relatively short in length and contact the conductor 202 for a minimum time before the conductor 202 moves into the conductor-holding region 58. The conductor-holding region 58 is defined by substantially thicker sidewalls 30 to form increased surface contacting areas and hence reduced bearing forces. The conductor-holding region 58 is designed to maintain sufficient bearing forces to continue electrical contact with the inserted conductor 202, but to ensure minimum deformation of the conductor 202. Thus, a number of connections at the same point of any given wire 200 is possible.

Also, upon completed insertion of a wire 200, the taper in the slot 20 (FIG. 1) adjusts so that the sidewalls 30 are substantially parallel to reduce any tendency of the contact element 10 in pushing the inserted conductor 202 back up the slot 20.

Referring back to FIG. 2, the ledges 34 beneath the mouth 32 are to help clear away any remaining insulation from the sliced region of the wire 200 being inserted so that none is accidentally pulled into the conductor-holding region 58. It is especially effective with the irradiated PVC insulated conductors. The ledges 34 primarily remove residual insulation and do minimal harm to the conductor 202.

Figure 5:
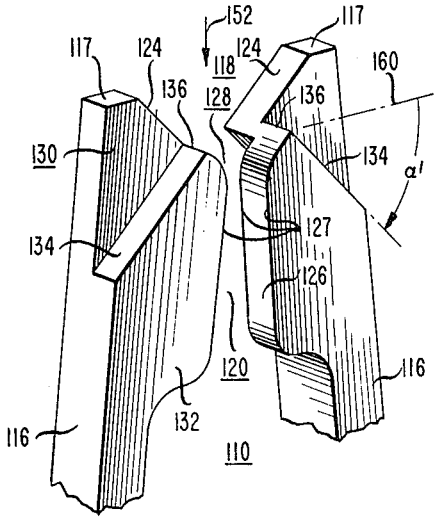
FIG. 5 shows in partial front perspective a second illustrative embodiment of a slotted beam contact element made in accordance with this invention.
Figure 6:
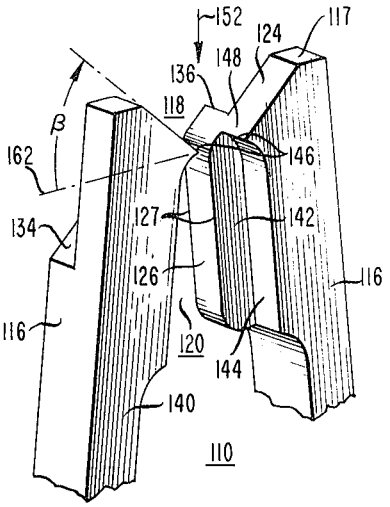
FIG. 6 shows a partial rear perspective view of the FIG. 5 contact element.

FIGS. 5 and 6 depict the portions of a second embodiment 110 of a slotted beam contact element that are different from the first embodiment 10. Similar to the FIG. 2 contact element, the furcations 116 on the contact element 110 also define between them a substantially V-shaped wire-guiding entrance 118 and a wire-gripping slot 120. Sidewalls 124 define the entrance 118, while planar sidewalls 126 define the wire-gripping slot 120 and form at their end adjacent the entrance 118 a mouth 128 (FIG. 5) to the wire-gripping slot 120. Each sidewall 124 curves and undergoes a gentle radius in the region of the mouth 128 to define a smooth and continuous surface with its associated sidewall 126.

Referring to FIG. 5, each furcation 116 includes a first coined region 130 having a reduced thickness on the front face 132 of the contact element 10 to form a ledge 134 contained in a plane normal to the plane of the contact element 110. Each ledge 134 intersects with its associated sidewall 124 to define a cutting edge 136, also normal to the plane of the contact element 110. The edge 136 is disposed at a predetermined location along the entrance 118 at a distance remote from the mouth 128 of the wire-gripping slot 120.

The spacing between the furcations 116 are exaggerated in FIGS. 5 and 6 for illustration purposes. In actuality, the furcations 16 are normally spaced approximately 2 mils apart at the mouth 28 and the cutting edges 136 are spaced approximately 16 mils apart, slightly greater than the diameter of the smallest conductor 202 to be accommodated in the illustrative embodiment.

Each ledge 134 slopes downward from its edge 136 to face away from the slot 120 and somewhat toward the free end 117 of the furcation 116. Each ledge 134 forms a positive rake angle $\alpha'$ with respect to the downward and vertical direction, denoted by arrow 152, in which a wire 220 is inserted. The angle $\alpha'$ is measured between a plane containing the surface on the ledge 134 contacting the wire 220 being inserted and a plane 160, which is perpendicular to the direction 152 and the plane of the contact element 10.

Hence, during wire insertion, the cutting edges 136 can aggressively cut into the insulation 224 to remove outer-insulation portions 229, while their associated ledges 134 can snag the severed outer-insulation portions 229. Because of the incline of the ledges 134, when the outer-insulation portions 229 are snagged by the ledges 134, the outer-insulation portions 229 press against the ledges 134 with forces having force components directed toward the wire-gripping slot 120. These forces supplement the furcations 116 in resisting furcation splitting and help the contact element 110 to further penetrate the insulation 224 on the wire 220.

It is apparent that the ledges 134 need not be planar, but can be curved so long as the surface regions adjacent the cutting edges 136 form positive rake angles with respect to the direction 152 of wire insertion.

Referring to FIG. 6, each furcation 116 includes on the rear face 140 of the contact element 110 a second coined region 142 of reduced thickness along its interior edge. Adjacent each coined region 142 is a sidewall 144 which terminates at one end along the entrance 118 and intersects with its associated sidewall 124 to produce an abrupt edge 146.

The surface region 148 on each sidewall 124 adjacent each edge 146 forms a negative rake angle $\beta$ with respect to the downward direction 152 in which a wire 220 is inserted. The rake angle $\beta$ for each furcation 116 is measured between a plane containing the surface region 148 which contacts the wire 220 as it passes its associated edge 146 and a plane 162 which is perpendicular to the direction 152 and the plane of the contact element 110. As a result, each edge 146 can operate as a line of concentrated forces for crushing irradiated PVC insulation.

The resulting thickness of each second sidewall 126 due to the coining on the rear face 140 is designed to form slicing edges 127 on the furcations 116 in the region of the mouth 128 and the wire-gripping slot 120. The sidewalls 126 can gently slice through the typical soft insulation 214 on a wire 210 or the remaining insulation on a wire 220 to establish reliable electrical connection.

Advantageously, in the illustrative embodiment, the sidewalls 126, which have a thickness substantially identical to that of the ledges 134, are aligned with the ledges 134 along an axis normal to the plane of the contact element 110. When a wire 220 is inserted, the cotton lacquered serving 228 is first removed by the cutting edges 136 and the snagging surfaces of ledges 134 to expose the soft PVC jacket 226 inside, which can then be easily penetrated by the sidewalls 126 of the wire-gripping slot 120.

While illustrative embodiments of the invention have been shown and described, it should be apparent that modifications can be made thereto without departing from the scope of the invention.

I claim:

1. A slotted beam contact element (10,110) for electrically terminating an insulated conductor (220) comprised of a conductor (202) surrounded by a jacket of insulation (224), where the contact element is a substantially planar conductive structure comprising a base portion (12), a bifurcated beam (14) with substantially parallel furcations (16,116) extending from the base portion where the furcations define between them a substantially V-shaped wire-guiding entrance (18,118) near the free ends (17,117) of the furcations, and a wire-gripping slot (20,120) formed with facing furcation sidewalls (30,126) where the sidewalls at their ends adjacent the entrance form a mouth (32,128) to the slot, the contact element being characterized by:

means for removing outer-insulation portions (228) from the insulation of the insulated conductor as the insulated conductor is guided toward the wire-gripping slot, the outer-insulation removing means being disposed at a predetermined location remote from the mouth and along the entrance, said outer-insulation removing means comprising a cutting edge on each furcation (16,116) substantially normal to the plane of the contact element, the cutting edge being defined by an intersection of a ledge (34,134) formed from a first coined region (11,130) on a first face (13,132) of the contact element with its associated entrance sidewall (26,124).

2. The contact element (10, 110) pursuant to claim 1 where on each furcation (16, 116), each entrance sidewall (26, 124) undergoes a gradual transition defined by a gentle radius to be continuous with its associated sidewall (30, 126).

3. The contact element (10) pursuant to claim 1 further comprising:

means for penetrating the remaining insulation on the insulated conductor (220) to establish electrical contact between the conductor (202) and the contact element.

4. The contact element (10, 110) pursuant to claim 1 where the wire-gripping slot (20, 120) in the unstressed state is tapered with the narrowest width in the region of the mouth (32, 128).

5. The contact element (10, 110) pursuant to claim 1 with a second identically configured beam (14, 114) extended from the base portion (12, 112).

6. The contact element (110) pursuant to claim 1 where each ledge (134) faces away from the wire-gripping slot (120) to cause its associated cutting edge (136) to cut into the insulation (224) with a positive rake angle ($\alpha'$).

7. The contact element (110) pursuant to claim 1 where each ledge (134) slopes sufficiently in a region adjacent its cutting edge (136) to receive a force from its associated outer-insulation portion (229) directed toward the wire-gripping slot (120).

8. The contact element (110) pursuant to claim 1 further comprising:

means for (146) crushing insulation.

9. The contact element (110) pursuant to claim 8 where the crushing means (146) includes a crushing edge (146) on each furcation (116) remote from the mouth (128) and along the entrance (118).

10. The contact element (110) pursuant to claim 9 where the crushing edge (146) on each furcation (116) is defined by the entrance sidewall (124) intersecting with a sidewall (144) adjacent a second coined region (142) on a second face (140) of the contact element.

11. The contact element (110) pursuant to claim 1 where each furcation (116) has a coined region (142) of reduced thickness on a second face (140) of the contact element in the area of the wire-gripping slot (120) so that the sidewalls (126) can apply sufficient bearing pressure on the wire 220 to penetrate the remaining insulation.

12. The contact element (110) pursuant to claim 11 where each sidewall (126) is in substantial collinear alignment with its associated cutting edge (136) along an axis normal to the plane of the contact element.

13. The contact element (110) pursuant to claim 11 where each coined region (142) is bounded by a sidewall (144) which terminates beyond the mouth (128) and slopes inward toward the center of the wire-guiding entrance (118) to intersect with its associated entrance sidewall (124).

14. A slotted beam contact element (10) for electrically terminating an insulated conductor (220) comprising a conductor (202) surrounded by a jacket of insulation (224) where the contact element is a substantially planar conductive structure comprising:

a base portion (12);

a beam (14) bifurcated to form substantially parallel furcations (16) extending from the base portion, the furcations defining between them a substantially V-shaped entrance (18) near the free ends (17) of the furcations and a wire-gripping slot (20), where the entrance is substantially defined by a first sidewall (24) and a second sidewall (26) on each furcation;

an indentation (28) on each furcation, each indentation defined by a surface means (29) connecting the first and second sidewalls on each furcation, the surface means intersecting with the second sidewall (26) on each furcation to define a cutting edge (44) such that the cutting edges (44) on both furcations are capable of cutting away outer portions (228) of the insulation (224);

a third substantially planar sidewall (30) on each furcation (16), the third sidewalls defining the wire-gripping slot (20), and at their end adjacent the entrance (18) defining a mouth (32) to the wire-gripping slot, each second sidewall (26) in the region of the mouth being defined by a curved surface which is continuous with the surface on its associated third planar sidewall; and an abrupt transition in the thickness in each of the third sidewalls (30) below the mouth (32) to the wire-gripping slot (20) to form below the abrupt transition a conductor-holding region (58), the conductor-holding region of the third sidewalls being somewhat thicker than the third sidewalls in the region of the mouth, the abrupt transition forming a ledge (34) substantially facing the free ends (17) of the beams, each ledge intersecting its associated third sidewall (30) to define a cutting edge (36).

15. The slotted beam contact element (10) pursuant to claim 14 further comprising:

means for penetrating the remaining insulation on the insulated conductor (220) to establish electrical contact between the conductor (202) and the contact element.

16. The slotted beam contact element (10) pursuant to claim 14 where the surface means (29) comprises a substantially concave surface (29) connecting the first (24) and second (26) sidewalls on each furcation (16).

17. The slotted beam contact element (10) pursuant to claim 14 where each surface means (29) has adjacent its associated cutting edge (44), a region (42) facing sufficiently away from the wire-gripping slot (20) to form a positive rake angle ($\alpha$) with respect to the insertion direction (52) of the insulated conductor (220).

18. The slotted beam contact element (10) pursuant to claim 14 where each surface means (29) has adjacent its associated cutting edge (44), a region (42) facing sufficiently away from the wire-gripping slot (20) so as to receive from the outer-insulation portions (228), a force (54) having a force component directed toward the wire-gripping slot.

19. The slotted beam contact (10) pursuant to claim 14 where on each furcation (16), the first sidewall (24) is set back with respect to its associated second sidewall (26) to enhance contact of the snagging surface means (29) and the cutting edge (44) with the insulated conductor (220) inserted.

* * * * *